US009826620B2

(12) United States Patent
Shibayama et al.

(10) Patent No.: US 9,826,620 B2
(45) Date of Patent: Nov. 21, 2017

(54) HIGH FREQUENCY GENERATING DEVICE AND HIGH FREQUENCY GENERATING METHOD USED IN PLASMA IGNITION APPARATUS

(71) Applicant: FUJITSU TEN LIMITED, Kobe-shi, Hyogo (JP)

(72) Inventors: Masashi Shibayama, Kobe (JP); Shoko Yamoto, Kobe (JP); Jyunya Tokinaga, Kobe (JP); Yusuke Masuda, Kobe (JP); Saori Aiba, Kobe (JP); Akio Okahara, Kobe (JP)

(73) Assignee: FUJITSU TEN LIMITED, Kobe (JP)

( * ) Notice: Subject to any disclaimer, the term of this patent is extended or adjusted under 35 U.S.C. 154(b) by 0 days.

(21) Appl. No.: 15/208,179

(22) Filed: Jul. 12, 2016

(65) Prior Publication Data

US 2017/0064805 A1 Mar. 2, 2017

(30) Foreign Application Priority Data

Aug. 24, 2015 (JP) ..... 2015-165049

(51) Int. Cl.

| | |
|---|---|
| ***H05H 1/46*** | (2006.01) |
| ***F02P 3/01*** | (2006.01) |
| ***F02P 23/04*** | (2006.01) |
| ***H05H 1/52*** | (2006.01) |
| ***F02P 3/04*** | (2006.01) |
| ***F02P 9/00*** | (2006.01) |
| ***F02P 11/06*** | (2006.01) |

(52) U.S. Cl.

CPC ..... *H05H 1/46* (2013.01); *F02P 3/01* (2013.01); *F02P 3/04* (2013.01); *F02P 9/007* (2013.01); *F02P 11/06* (2013.01); *F02P 23/04* (2013.01); *F02P 23/045* (2013.01); *H05H 1/52* (2013.01); *H05H 2001/463* (2013.01); *H05H 2001/4682* (2013.01)

(58) Field of Classification Search

CPC ..... H05H 1/46; H05H 1/52; H05H 2001/463; H05H 2001/4682; F02P 3/01; F02P 3/04; F02P 9/00; F02P 9/007; F02P 11/06; F02P 23/04; F02P 13/045

See application file for complete search history.

(56) References Cited

U.S. PATENT DOCUMENTS 9,035,564 B1 * 5/2015 Itoi ..... H01T 15/00 315/224
9,695,794 B2 * 7/2017 Yamoto ..... F02P 3/01

FOREIGN PATENT DOCUMENTS

JP 2011-007161 A 1/2011
JP 2014-185544 A 10/2014

* cited by examiner

*Primary Examiner* — Hieu T Vo
(74) *Attorney, Agent, or Firm* — Oliff PLC

(57) ABSTRACT

A high frequency generating device used in a plasma ignition apparatus according to an embodiment includes a high frequency output unit, an output control unit, a current detecting unit, and an abnormality detecting unit. The high frequency output unit outputs a high frequency. The output control unit shifts a state of the high frequency output unit from a non-output state to an output-ready state of the high frequency. The current detecting unit detects a current that flows through a power-supply path to the high frequency output unit. The abnormality detecting unit detects output abnormality of the high frequency in the non-output state when a value of a current detected by the current detecting unit in the non-output state exceeds a non-output threshold.

10 Claims, 6 Drawing Sheets

HIGH FREQUENCY GENERATING DEVICE AND HIGH FREQUENCY GENERATING METHOD USED IN PLASMA IGNITION APPARATUS

CROSS-REFERENCE TO RELATED APPLICATION

This application is based upon and claims the benefit of priority of the prior Japanese Patent Application No. 2015-165049, filed on Aug. 24, 2015, the entire contents of which are incorporated herein by reference.

FIELD

The embodiment discussed herein is directed to a high frequency generating device and a high frequency generating method used in a plasma ignition apparatus.

BACKGROUND

Conventionally, in an internal-combustion engine such as an automobile engine, a plasma ignition apparatus is proposed that supplies, for the expansion of a plasma region, a high frequency to a spark discharge as a core of the plasma to ignite an air-fuel mixture. Herein, the spark discharge is generated in a combustion chamber by using an ignition plug. This kind of plasma ignition apparatus includes a high frequency generating device that generates the high frequency (for example, Japanese Laid-open Patent Publication No. 2014-185544).

However, in the aforementioned conventional technology, for example, when a short circuit or the like occurs in a signal path to the high frequency generating device, the high frequency may be output at an unintended

SUMMARY

A high frequency generating device used in a plasma ignition apparatus according to an embodiment includes a high frequency output unit, an output control unit, a current detecting unit, and an abnormality detecting unit. The high frequency output unit outputs a high frequency. The output control unit shifts a state of the high frequency output unit from a non-output state to an output-ready state of the high frequency. The current detecting unit detects a current that flows through a power-supply path to the high frequency output unit. The abnormality detecting unit detects output abnormality of the high frequency in the non-output state when a value of a current detected by the current detecting unit in the non-output state exceeds a non-output threshold.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENT

Hereinafter, a high frequency generating device and a high frequency generating method used in a plasma ignition apparatus according to the present embodiment will be described in detail with reference to drawings. In the present embodiment, explanation is performed in an example that the plasma ignition apparatus is used in a vehicle engine, however the plasma ignition apparatus can be used in an internal-combustion engine other than the vehicle engine. Moreover, it is not intended that the present invention be limited to the embodiment described below.

1. Plasma Ignition Apparatus

Figure 1:
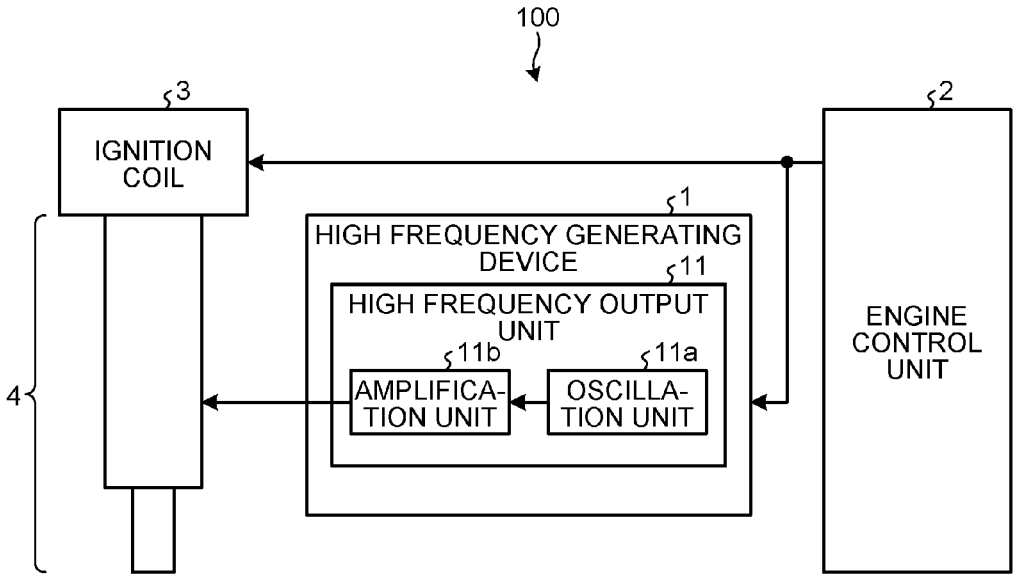
FIG. 1 is a schematic view illustrating a plasma ignition apparatus according to an embodiment.

A summary of the plasma ignition apparatus according to the present embodiment will be explained with reference to FIG. 1. FIG. 1 is a schematic view illustrating a plasma ignition apparatus 100 according to the present embodiment.

As illustrated in FIG. 1, the plasma ignition apparatus 100 includes a high frequency generating device 1, an engine control unit 2, an ignition coil 3, and an ignition plug 4.

The engine control unit 2 outputs an ignition signal to the ignition coil 3 at timing corresponding to a driving situation or the like of the vehicle. The ignition signal is a signal for controlling timing at which a spark discharge is generated by the ignition plug 4. The ignition signal is also input to the high frequency generating device 1.

A set of the high frequency generating device 1, the ignition coil 3, and the ignition plug 4 is provided for each of the cylinders of the engine. The engine control unit 2 controls the high frequency generating device 1, the ignition coil 3, and the ignition plug 4 that are provided for each of the cylinders.

The ignition coil 3 receives input of the ignition signal from the engine control unit 2 and generates a high voltage. Substantially, the ignition coil 3 includes primary and secondary coils (not illustrated), feeds a current to the primary coil by turning on the ignition signal, and generates the high voltage at the secondary coil by an induction phenomenon caused by turning off the ignition signal and cutting off the current that flows into the primary coil. The generated high voltage is supplied to the ignition plug 4.

The ignition plug 4 generates the spark discharge in a combustion chamber using the high voltage supplied from the ignition coil 3. When a high frequency (microwave) is supplied from the high frequency generating device 1, the ignition plug 4 also functions as an antenna that is to radiate the high frequency into the combustion chamber. When the high frequency is radiated into the combustion chamber from the ignition plug 4, a plasma region is enlarged by supplying the high frequency to a spark discharge as a core of the plasma, and an air-fuel mixture in the combustion chamber is ignited. Thus, the air-fuel mixture can be combusted stably, for example, when driving the engine with an air-fuel mixture that is leaner than the theoretical air-fuel ratio. A dedicated antenna for radiating the high frequency into the combustion chamber may be provided separately from the ignition plug 4. In this case, the high frequency generating device 1 supplies the high frequency to the dedicated antenna.

The high frequency generating device 1 outputs the high frequency to the ignition plug 4 in accordance with timing at which the ignition signal is output from the engine control unit 2. Substantially, the high frequency generating device 1 includes a high frequency output unit 11, and the high frequency output unit 11 includes an oscillation unit 11*a* that oscillates the high frequency and an amplification unit 11*b* that amplifies the high frequency oscillated by the oscillation unit 11*a*. The high frequency generating device 1 supplies the ignition plug 4 with the high frequency that is amplified by the amplification unit 11*b* of the high frequency output unit 11.

Specifically, when the ignition signal is input from the engine control unit 2, the high frequency generating device 1 first shifts the state of the oscillation unit 11*a* from an oscillation disabled state to an oscillation enabled state of the high frequency. Thus, the state of the high frequency output unit 11 shifts from a non-output state to an output-ready state of high frequency. When the state of the oscillation unit 11*a* is shifted from the oscillation disabled state to the oscillation enabled state, a weak current flows through the high frequency output unit 11.

And then, in accordance with timing at which the ignition signal is turned off and ignition is performed, the high frequency generating device 1 instructs the oscillation unit 11*a* to oscillate the high frequency and the amplification unit 11*b* to amplify the high frequency. Thus, the state of the high frequency output unit 11 shifts from the output-ready state to the output state, in other words, the state in which supplying the ignition plug 4 with the high frequency that is amplified by the amplification unit 11*b*.

In a conventional technology, for example, when abnormality such as a short circuit occurs in the path through which an ignition signal is output from an engine control unit to a high frequency generating device, there is a possibility that a high frequency is output from the high frequency generating device even if the ignition signal is not input actually. In such a case, there is a possibility that malfunction such as, for example, a misfire or leakage of the high frequency from the combustion chamber occurs.

Therefore, in the high frequency generating device 1 according to the present embodiment, a process for detecting the output abnormality of the high frequency is to be performed.

Specifically, in the high frequency generating device 1 according to the present embodiment, the output abnormality of the high frequency in the non-output state is detected on the basis of a weak current that flows when the state of the oscillation unit 11*a* shifts from the oscillation disabled state to the oscillation enabled state. In other words, when the weak current is detected in the non-output state, because the oscillation unit 11*a* that is in the oscillation disabled state is supposed to be in the oscillation enabled state, in such a case, the high frequency generating device 1 detects the output abnormality of the high frequency in the non-output state.

In this way, according to the high frequency generating device 1, it is possible to detect the output abnormality of the high frequency in the non-output state.

Moreover, the high frequency generating device 1 according to the present embodiment performs processes for detecting the output abnormality of the high frequency in not only the non-output state but also the output-ready and output states. These points will be described below.

Also, the high frequency generating device 1 according to the present embodiment performs a predetermined abnormality handling process when the output abnormality of the high frequency is detected. For example, the high frequency generating device 1 inhibits the state of the oscillation unit 11*a* from shifting to the oscillation enabled state, or cuts off a power-supply path to the high frequency output unit 11, as the abnormality handling process. These points will be also described below.

2. High Frequency Generating Device

Figure 2:
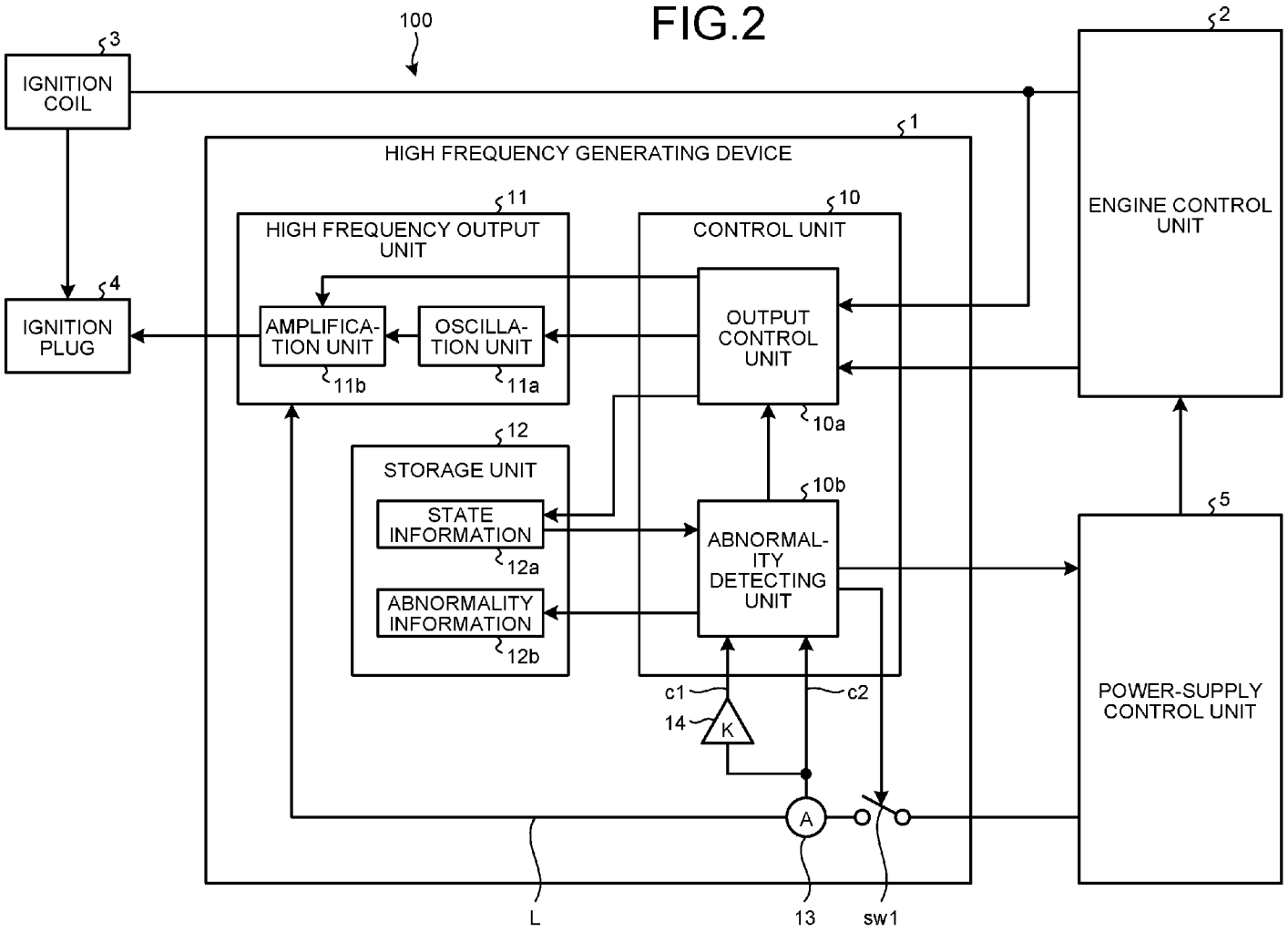
FIG. 2 is a diagram illustrating a configuration example of a high frequency generating device.

Hereinafter, the high frequency generating device 1 will be specifically explained with reference to FIGS. 2 to 9. FIG. 2 is a diagram illustrating a configuration example of the high frequency generating device 1. As illustrated in FIG. 2, the high frequency generating device 1 includes a control unit 10, the high frequency output unit 11, a storage unit 12, a current detecting unit 13, an amplifier 14, a power-supply path L, a first input path c1, a second input path c2, and a switch sw1.

The plasma ignition apparatus 100 further includes a power-supply control unit 5. The power-supply control unit 5 is connected to the engine control unit 2 and the high frequency generating device 1 that are respectively provided for the cylinders.

2.1 High Frequency Output Unit

The high frequency output unit 11 outputs the high frequency to the ignition plug 4 in accordance with control of the control unit 10. The high frequency output unit 11 includes the oscillation unit 11*a* and the amplification unit 11*b*.

The oscillation unit 11*a* oscillates the high frequency in accordance with control of an output control unit 10*a* to be mentioned later. Substantially, the state of the oscillation unit 11*a* shifts from the oscillation disabled state (OFF state) to the oscillation enabled state (ON state) of the high frequency, when an oscillation ready signal is input from the output control unit 10*a*. Subsequently, the oscillation unit 11*a* starts oscillation of the high frequency at the timing at which the amplification unit 11*b* is turned ON by the output control unit 10*a*, and outputs the oscillated high frequency to the amplification unit 11*b*.

The amplification unit 11*b* amplifies the high frequency that is oscillated by the oscillation unit 11*a*, and supplies the amplified high frequency to the ignition plug 4.

Specifically, the amplification unit 11*b* turns ON when an amplification signal is input from the output control unit 10*a*, starts amplification of the high frequency, and supplies the amplified high frequency to the ignition plug 4. Moreover, the amplification signal includes setting information such as, for example, an amplification factor and the amplification unit 11*b* amplifies the high frequency in accordance with the setting information.

The oscillation unit 11*a* and the amplification unit 11*b* are operated by a supply voltage from the power-supply control unit 5 through the power-supply path L. When the state of the oscillation unit 11*a* is shifted from the oscillation disabled state to the oscillation enabled state, the weak current about 2 mA to 5 mA flows through the power-supply path L.

2.2 Power-Supply Path and Switch

The power-supply path L is a path for supplying the voltage from the power-supply control unit 5 to the high frequency output unit 11. The switch sw1 is provided on the power-supply path L, and it switches between a supply state and a supply cut-off state of the voltage to the high frequency output unit 11.

Now, the power-supply control unit 5 will be explained. The power-supply control unit 5 is connected to a not illustrated on-vehicle battery, and boosts a voltage (for example, 12V) supplied from the on-vehicle battery up to a predetermined voltage (for example, 32V).

The voltage boosted by the power-supply control unit 5 is supplied to the high frequency output unit 11 of the high frequency generating device 1 that is provided for each of the cylinders (for example, four cylinders). The power-supply control unit 5 acquires abnormality information 12*b* from an abnormality detecting unit 10*b* of the high frequency generating device 1 that is provided for each of the cylinders, and outputs the acquired abnormality information 12*b* to the engine control unit 2.

2.3 Current Detecting Unit

The current detecting unit 13 is provided on the power-supply path L and detects a current that flows through the power-supply path L. In FIG. 2, an example in which the current detecting unit 13 is provided in the downstream side of the switch sw1 is illustrated, however, the current detecting unit 13 may be provided in the upstream side of the switch sw1.

2.4 First Input Path, Second Input Path, and Amplifier

The first and second input paths c1 and c2 are paths through which detection results (referred to as "detection signals" hereinafter) of the current detecting unit 13 is input to the abnormality detecting unit 10*b*. The amplifier 14 is provided on the first input path c1 and amplifies the level of the detection signal that is output from the current detecting unit 13.

Therefore, the detection signal that is output from the current detecting unit 13 is input to the abnormality detecting unit 10*b* through the first input path c1 and the amplifier 14 and is input to the abnormality detecting unit 10*b* through the second input path c2. In other words, the detection signal that is amplified by the amplifier 14 and the detection signal that is not amplified by the amplifier 14 are input to the abnormality detecting unit 10*b*.

2.5 Control Unit

The control unit 10 includes the output control unit 10*a* and the abnormality detecting unit 10*b*. The control unit 10 is, for example, a microcomputer that includes a Central Processing Unit (CPU), a Random Access Memory (RAM), and a Read Only Memory (ROM). The CPU functions as the aforementioned output control unit 10*a* and abnormality detecting unit 10*b* by, for example, performing an operation process in accordance with a program previously stored in the ROM.

2.5.1 Output Control Unit

The output control unit 10*a* controls output of the high frequency from the high frequency output unit 11 on the basis of the ignition signal and a setting signal that are input from the engine control unit 2.

Specifically, when the ignition signal is input from the engine control unit 2, the output control unit 10*a* outputs the oscillation ready signal to the oscillation unit 11*a* after a predetermined time elapses from the time at which the ignition signal is input.

When the setting signal is input from the engine control unit 2, the output control unit 10*a* instructs the oscillation unit 11*a* to oscillate the high frequency and the amplification unit 11*b* to amplify the high frequency in accordance with the input setting signal.

Specifically, the setting signal includes information such as oscillation timing and an amplification factor of the high frequency, the output control unit 10*a* outputs an oscillation signal to the oscillation unit 11*a* at the oscillation timing included in the setting information. Thus, the oscillation unit 11*a* starts oscillation of the high frequency.

The output control unit 10*a* outputs the amplification signal that indicates the fact that the high frequency is amplified at the amplification factor or the like indicated by the setting information to the amplification unit 11*b* at the aforementioned oscillation timing. Therefore, the amplification unit 11*b* amplifies the high frequency at the indicated amplification factor or the like.

The output control unit 10*a* performs a process that stores a state information 12*a* in the storage unit 12 that represents a current state of the high frequency output unit 11.

Figure 3:
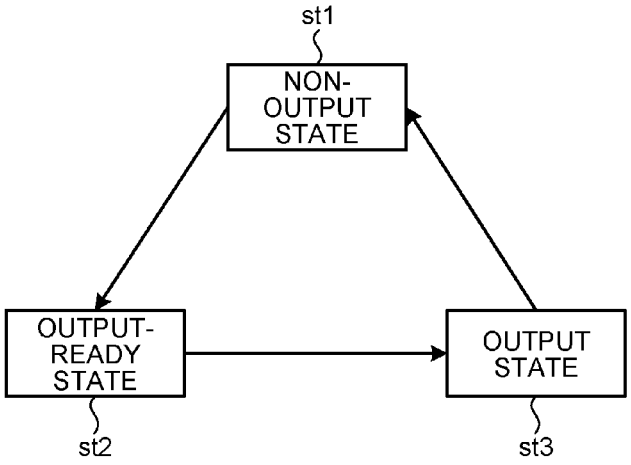
FIG. 3 is a diagram illustrating contents of state information.
Figure 4:
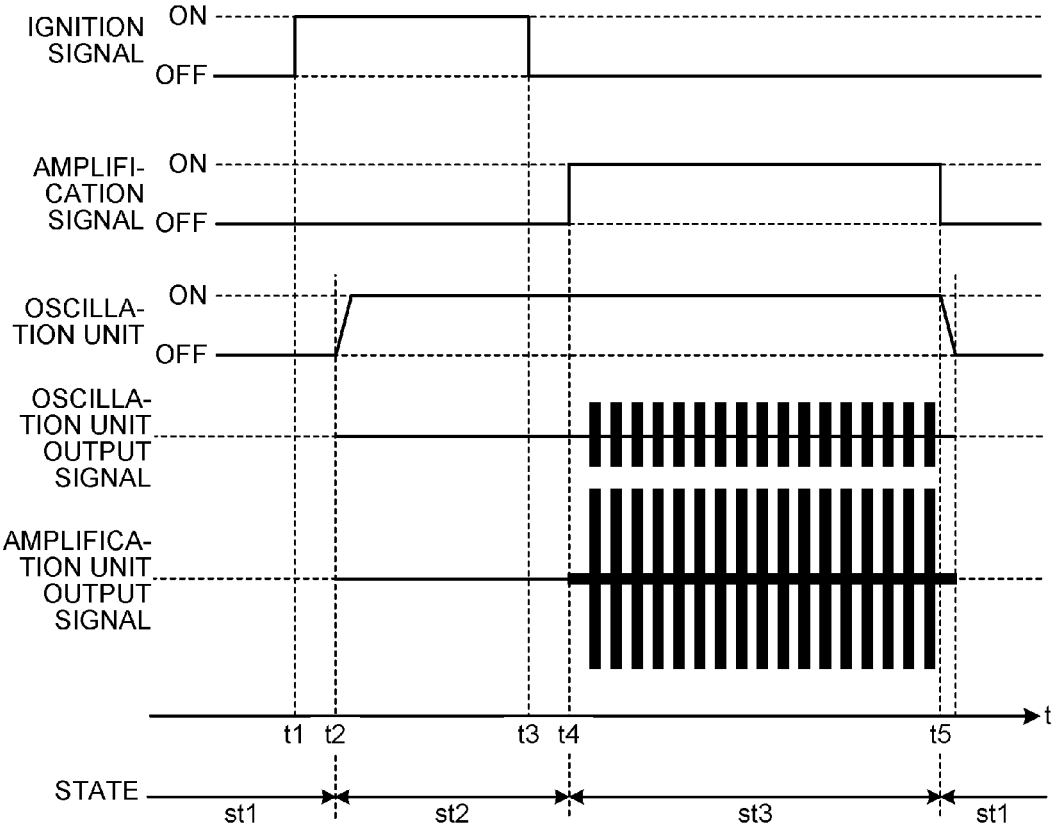
FIG. 4 is a diagram illustrating state shifts of a high frequency output unit.

Now, the state information 12*a* of the high frequency output unit 11 will be explained with reference to FIGS. 3 and 4. FIG. 3 is a diagram illustrating contents of the state information 12*a*. FIG. 4 is a diagram illustrating state shifts of the high frequency output unit 11.

As illustrated in FIG. 3, there are three states in the states of the high frequency output unit 11: a "non-output state st1", a "output-ready state st2", and a "output state st3".

The "non-output state st1" is the state in which the oscillation unit 11*a* cannot output the high frequency because the oscillation unit 11*a* is in the oscillation disabled state (OFF state). The "output-ready state st2" is a state in which the oscillation unit 11*a* becomes able to output the high frequency by shifting to the oscillation enabled state (ON state). The "output state st3" is a state in which the oscillation unit 11*a* oscillates the high frequency and the amplification unit 11*b* amplifies the high frequency, and thus the desired high frequency is output from the high frequency output unit 11.

The state of the high frequency output unit 11 sequentially shifts in the order of the non-output state st1→the output-ready state st2→the output state st3→the non-output state st1→, etc. in accordance with the control of the output control unit 10*a*.

Specifically, as illustrated in FIG. 4, when the ignition signal is input to the output control unit 10*a*, in other words, the ignition signal shifts from OFF to ON (at time t1), the output control unit 10*a* outputs the oscillation ready signal to the oscillation unit 11*a* (at time t2) after a predetermined time elapses. Therefore, the state of the oscillation unit 11*a* starts to shift from the oscillation disabled state to the oscillation enabled state, and the state of the high frequency output unit 11 shifts from the non-output state st1 to the output-ready state st2.

The output control unit 10*a*, for example, when outputting the oscillation ready signal to the oscillation unit 11*a*, updates the non-output state st1 of the state information 12*a* stored in the storage unit 12 with the output-ready state st2.

Next, the output control unit 10*a*, when the input of the ignition signal ends, in other words, the ignition signal shifts from ON to OFF (at time t3), outputs the oscillation signal to the oscillation unit 11*a* after waiting until the oscillation timing indicated by the setting signal, and outputs the amplification signal to the amplification unit 11*b* (at time t4). Thus, the oscillation unit 11*a* oscillates the high frequency, the amplification unit 11*b* amplifies the high frequency, and the state of the high frequency output unit 11 shifts from the output-ready state st2 to the output state st3.

The output control unit 10*a*, for example, when outputting the oscillation signal to the oscillation unit 11*a* and outputting the amplification signal to the amplification unit 11*b*, updates the output-ready state st2 of the state information 12*a* stored in the storage unit 12 with the output state st3.

When the state of the high frequency output unit 11 shifts to the output state st3, the oscillation unit 11*a* oscillates the high frequency at frequency of 2.45 GHz, for example, and the amplification unit 11*b* amplifies the high frequency that is oscillated at the frequency in the oscillation unit 11*a*. The high frequency amplified by the amplification unit 11*b* is supplied to the ignition plug 4.

Subsequently, when the output control unit 10*a* shifts the amplification signal from ON to OFF, the oscillation unit 11*a* stops oscillating the high frequency and the state of the output control unit 10*a* shifts from the oscillation enabled state to the oscillation disabled state, and the amplification unit 11*b* also stops amplifying the high frequency and the state of the amplification unit 11*b* shifts to the OFF state (at time t5). Therefore, the state of the high frequency output unit 11 shifts from the output state st3 to the non-output state st1.

When, for example, shifting the amplification signal from ON to OFF, the output control unit 10*a* updates the output state st3 of the state information 12*a* stored in the storage unit 12 with the non-output state st1.

2.5.2 Abnormality Detecting Unit

Return to FIG. 2, the abnormality detecting unit 10*b* will be explained. The abnormality detecting unit 10*b* detects output abnormality of the high frequency on the basis of the detection signal that is input from the current detecting unit 13 and the state information 12*a* stored in the storage unit 12.

Specifically, the abnormality detecting unit 10*b* detects the output abnormality of the high frequency by comparing the detection signal with thresholds that are different for each of the states (non-output state st1, output-ready state st2, and output state st3) of the high frequency output unit 11 indicated by the state information 12*a*.

When the high frequency output unit 11 is in the "non-output state st1" or the "output-ready state st2", the abnormality detecting unit 10*b* detects abnormality on the basis of a detection signal (referred to as "first detection signal" hereinafter) that is input through the first input path c1 and the amplifier 14. On the other hand, when the high frequency output unit 11 is in the "output state st3", the abnormality detecting unit 10*b* detects abnormality on the basis of a detection signal (referred to as "second detection signal" hereinafter) that is input through the second input path c2.

Figure 5:
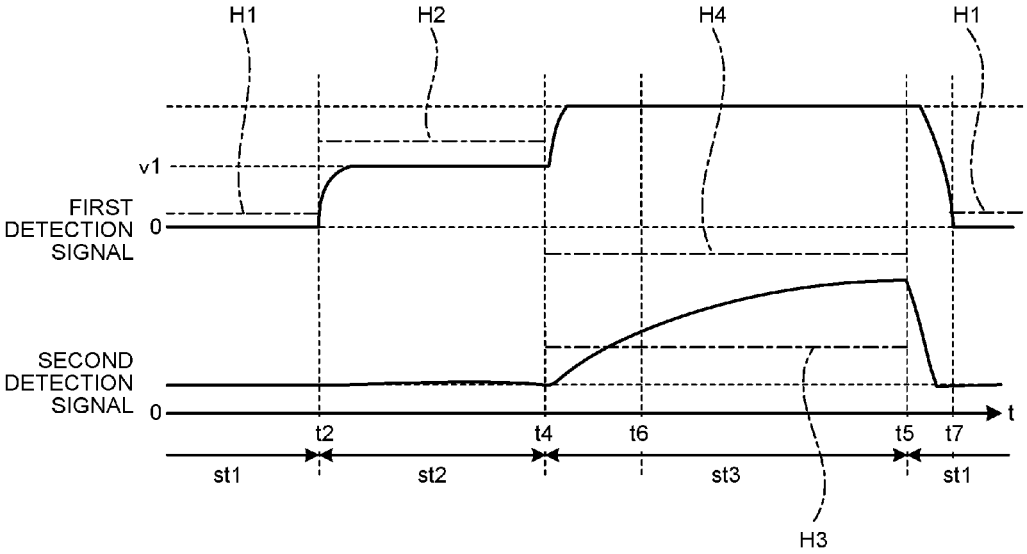
FIG. 5 is a diagram illustrating an example of an abnormality detection process.

Now, details of an abnormality detection process that is performed by the abnormality detecting unit 10*b* will be explained with reference to FIG. 5. FIG. 5 is a diagram illustrating an example of the abnormality detection process.

As illustrated in FIG. 5, when the high frequency output unit 11 is in the non-output state st1 (before time t2), because the oscillation unit 11*a* and the amplification unit 11*b* is in OFF state, a current does not flow through the power-supply path L. Therefore, the value of the detection signal in the non-output state st1 is 0 in principle.

Subsequently, when the state of the high frequency output unit 11 shifts from the non-output state st1 to the output-ready state st2 (time t2 to t4), the oscillation unit 11*a* turns to the oscillation enabled state (ON state). Thus, a weak current of about 2 mA to 5 mA flows through the power-supply path L.

When the state of the high frequency output unit 11 shifts from the output-ready state st2 to the output state st3 (time t4 to t5), the amplification unit 11*b* also turns to the ON state, and the oscillation unit 11*a* oscillates the high frequency and the amplification unit 11*b* amplifies the high frequency. Therefore, a current of, for example, about 1 A to 2 A flows through the power-supply path L.

When the high frequency output unit 11 is in the non-output state st1, the abnormality detecting unit 10*b* compares the first detection signal with a non-output threshold H1. The non-output threshold H1 is set to less than or equal to v1 that is the value of a current that flows through the power-supply path L in such a case that the oscillation unit 11*a* is in the oscillation enabled state (namely, in output-ready state st2). The non-output threshold H1 is set to, for example, 1 mA.

The abnormality detecting unit 10*b* detects the output abnormality of the high frequency when the value of the first detection signal exceeds the non-output threshold H1 in the non-output state st1, in other words, when it is detected that a current flows in the non-output state st1 in which the current does not flow through the power-supply path L originally.

As abnormality in the case, for example, abnormality (for example, short circuit) in the path from the output control unit 10*a* to the oscillation unit 11*a* is supposed. This is because when abnormality such as the short circuit occurs on the path, a signal is input erroneously to the oscillation unit 11*a*, as a result, there is a possibility that the state of the oscillation unit 11*a* shifts to the oscillation enabled state at an unintended timing.

When the high frequency output unit 11 is in the output-ready state st2, the abnormality detecting unit 10*b* compares the first detection signal with an output-ready threshold H2. The output-ready threshold H2 is the threshold that is set to more than the value of a current that flows through the power-supply path L in such a case that the state of the oscillation unit 11*a* turns to the oscillation enabled state. The output-ready threshold H2 is set to, for example, 10 mA.

The abnormality detecting unit 10*b* detects the output abnormality of the high frequency when the value of the first detection signal exceeds the output-ready threshold H2 in the output-ready state st2. As abnormality in the case, for example, an overcurrent or the like is supposed.

The values of currents detected by the current detecting unit 13 in the non-output state st1 and the output-ready state st2 are zero or minute in principle. Therefore, because the value of the second detection signal that is not amplified by the amplifier 14 is also 0 or minute, it is difficult to perform comparison with a threshold using the second detection signal. Therefore, when the high frequency output unit 11 is in the non-output state st1 or the output-ready state st2, the abnormality detecting unit 10*b* performs abnormality detection using the first detection signal that is an amplified detection signal by the amplifier 14.

On the contrary, because the value of a current that is detected by the current detecting unit 13 in the output state st3 is very large compared with values of currents that flow in the non-output and output-ready states st1 and st2, the value of the first detection signal amplified by the amplifier 14 exceeds a detectable upper limit value. Thus, when using the first detection signal, it becomes difficult to properly detect the output abnormality of the high frequency in the output state st3. Therefore, the abnormality detecting unit 10*b* detects the output abnormality of the high frequency using the second detection signal that is not amplified by the amplifier 14 when the high frequency output unit 11 is in the output state st3.

Specifically, the abnormality detecting unit 10*b* compares the second detection signal with the lower and upper output thresholds H3 and H4 when the high frequency output unit 11 is in the output state st3. The lower output threshold H3 is set to the value of, for example, 200 mA that is larger than the value of the aforementioned output-ready threshold H2.

The upper output threshold H4 is set to the value of, for example, 3 A that is larger than the value of the lower output threshold H3.

The abnormality detecting unit 10*b* detects the output abnormality of the high frequency when the value of the second detection signal deviates from a range between the lower output threshold H3 and the upper output threshold H4 in the output state st3. For example, a disconnection or the like is supposed when the value of the second detection signal is less than the lower output threshold H3, and, for example, an overcurrent or the like is supposed when the value of the second detection signal exceeds the upper output threshold H4.

As illustrated in FIG. 5, when the state of the high frequency output unit 11 shifts to the output state st3, the value of a current (second detection signal illustrated in FIG. 5) that flows through the power-supply path L gently rises without rising immediately. Therefore, if the abnormality detecting unit 10*b* performs a detection process of the output abnormality of the high frequency immediately after the state of the high frequency output unit 11 shifts to the output state st3, there is a possibility that the output abnormality is detected erroneously between the time t4 and the time t6.

Therefore, the abnormality detecting unit 10*b* determines whether or not the value of the second detection signal deviates from a range between the lower output threshold H3 and the upper output threshold H4 after a predetermined time elapses from the time at which the high frequency output unit 11 shifts to the output state st3 after, for example, a time t6 that is illustrated in FIG. 5. Therefore, it is possible to prevent an erroneous detection of the output abnormality of the high frequency.

The abnormality detecting unit 10*b* detects the output abnormality of the high frequency on the basis of the value of the first detection signal when the state of the high frequency output unit 11 shifts form the output state st3 to the non-output state st1 (after time t7). As illustrated in FIG. 5, the value of the first detection signal returns to 0, for example, after a predetermined time elapses from the time at which the output state st3 shifts to the non-output state st1. Therefore, the abnormality detecting unit 10*b* may perform the abnormality detection process after a predetermined time elapses (after time t7) also in such a case that the output state st3 turns to the non-output state st1.

The abnormality detecting unit 10*b* may detect the output abnormality of the high frequency in such a case that a state in which the value of the first detection signal or the second detection signal exceeds a predetermined threshold continues for a predetermined time.

For example, in such a case that abnormality occurs in the output control unit 10*a* and the high frequency output unit 11 is erroneously controlled to be in the output state st3 constantly, there is a possibility that malfunction such as a misfire by output of the high frequency and leakage of the high frequency occurs.

Therefore, the abnormality detecting unit 10*b* may detect the output abnormality of the high frequency in such a case that a state in which the value of the second detection signal is within the range between the lower output threshold H3 and the upper output threshold H4 continues for a predetermined time in the output state st3. As a result, the output abnormality of the high frequency can be detected even if abnormality occurs in the output control unit 10*a*.

In this way, in the states (non-output state st1, output-ready state st2, and output state st3) of the high frequency output unit 11, the abnormality detecting unit 10*b* detects the output abnormality of the high frequency by using the thresholds (non-output threshold H1, output-ready threshold H2, and lower and upper output thresholds H3 and H4) respectively corresponding to the states. Therefore, the abnormality detecting unit 10*b* can detect the output abnormality of the high frequency in each of the states of the high frequency output unit 11.

The abnormality detecting unit 10*b* detects the output abnormality of the high frequency in the non-output and output-ready states st1 and st2 on the basis of the first detection signal that is input via the first input path c1 and the amplifier 14, and detects the output abnormality of the high frequency in the output state st3 on the basis of the second detection signal that is input via the second input path c2. Therefore, the abnormality detecting unit 10*b* can detect the output abnormality of the high frequency in each of the states of the non-output state st1, the output-ready state st2, and the output state st3.

Also, the abnormality detecting unit 10*b* performs a predetermined abnormality handling process when detecting the output abnormality of the high frequency by the aforementioned abnormality detection process.

For example, the abnormality detecting unit 10*b* performs a process of storing the abnormality information 12*b* in the storage unit 12. Now, the abnormality information 12*b* is information including the state information 12*a*, the output level of the detection signal, and time or the like when the abnormality is detected. The abnormality detecting unit 10*b* also performs a process of outputting the abnormality information 12*b* to the power-supply control unit 5.

In this way, because the abnormality information 12*b* is stored or is output to the power-supply control unit 5, the repairer can easily specify the cause of the abnormality and thus can shorten the repair time by carrying out the repair on the basis of the abnormality information 12*b* when the repair of the high frequency generating device 1 having the detected abnormality is carried out, for example.

As the abnormality handling process, the abnormality detecting unit 10*b* may perform a process that turns the switch sw1 OFF that is provided on the power-supply path L to the high frequency output unit 11 to cut off the power supply to the high frequency output unit 11.

Power is not supplied to the high frequency output unit 11 to stop an output function of the high frequency when the switch sw1 is turned OFF. Moreover, it may be possible that the abnormality detecting unit 10*b* outputs the abnormality information 12*b* to the power-supply control unit 5 and the power-supply control unit 5 stops the power supply to the high frequency output unit 11.

Therefore, for example, even if an abnormality occurs in the output control unit 10*a*, malfunction such as a misfire by the output abnormality of the high frequency or the leakage of the high frequency from the combustion chamber can be surely prevented by cutting off the power supply to the high frequency output unit 11.

The abnormality detecting unit 10*b*, as the abnormality handling process, may inhibit the shift of the oscillation unit 11*a* into the oscillation enabled state. For example, the abnormality detecting unit 10*b* may instruct the output control unit 10*a* not to perform an instruction that makes the state of the oscillation unit 11*a* shift from the oscillation disabled state to the oscillation enabled state.

As a result, because the output control unit 10*a* does not perform the process that shifts the state of oscillation unit 11*a* into the oscillation enabled state even if the ignition and setting signals are input, the shift of the state of the high frequency output unit 11 from the non-output state st1 to the output-ready state st2 can be inhibited.

The output control unit 10*a*, as the abnormality handling process, may output the amplification signal including an amplification factor that is less than the amplification factor indicated by the setting signal to the amplification unit 11*b*. Therefore, for example, malfunction by the output abnormality of the high frequency can be maintained in a minimum.

2.6 Storage Unit

The storage unit 12 stores the state information 12*a* and the abnormality information 12*b*. The storage unit 12 is a storage device such as, for example, a semiconductor memory device such as a Random Access Memory (RAM) or a flash memory, a hard disk, and an optical disk.

3.1 Abnormality Detection Process

Figure 6:
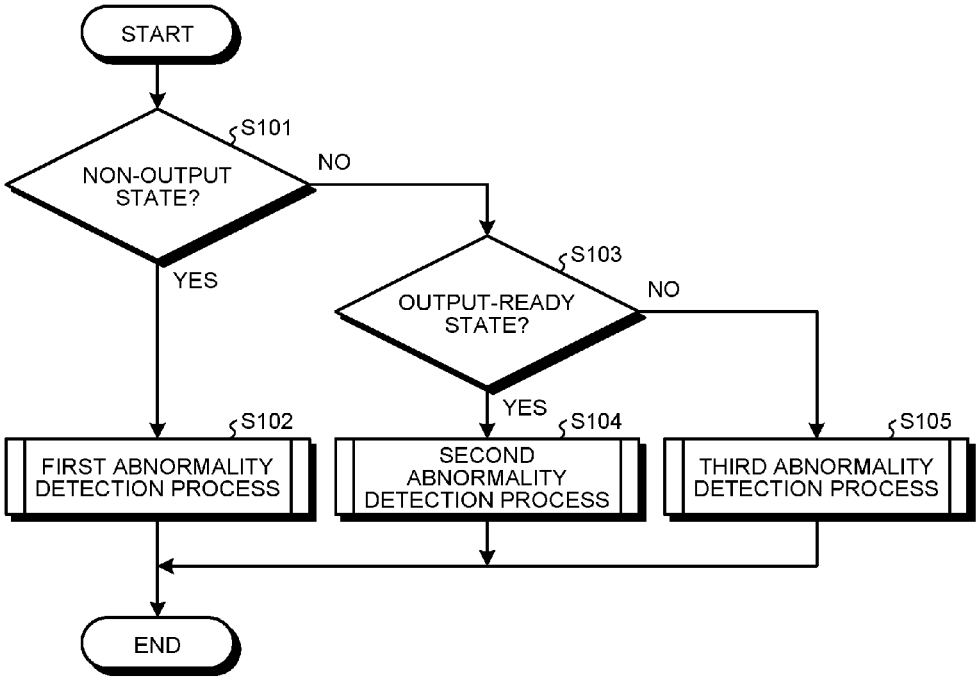
FIG. 6 is a flow chart illustrating a procedure for the abnormality detection process that is executed by the high frequency generating device.

A sequence for the abnormality detection process executed by the high frequency generating device 1 will now be described with reference to FIG. 6. FIG. 6 is a flow chart illustrating the procedure for the abnormality detection process that is executed by the high frequency generating device 1. The process is executed by the abnormality detecting unit 10*b* repeatedly.

As illustrated in FIG. 6, the abnormality detecting unit 10*b* determines whether or not the high frequency output unit 11 is in the non-output state st1 on the basis of the state information 12*a* acquired from the storage unit 12 (Step S101). In the determination process, when it is determined that the high frequency output unit 11 is in the non-output state st1 (Step S101; Yes), the abnormality detecting unit 10*b* performs a first abnormality detection process (Step S102). The sequence for the first abnormality detection process will be explained later with reference to FIG. 7.

Otherwise, in Step S101, when the high frequency output unit 11 is not in the non-output state st1 (Step S101; No), the abnormality detecting unit 10*b* determines whether or not the high frequency output unit 11 is in the output-ready state st2 (Step S103). In the determination process, when it is determined that the high frequency output unit 11 is in the output-ready state st2 (Step S103; Yes), the abnormality detecting unit 10*b* performs a second abnormality detection process (Step S104). The sequence for the second abnormality detection process will be explained later with reference to FIG. 8.

Otherwise, in Step S103, when it is determined that the high frequency output unit 11 is not in the output-ready state st2 (Step S103; No), in other words, the high frequency output unit 11 is in the output state st3, the abnormality detecting unit 10*b* performs a third abnormality detection process (Step S105). The sequence for the third abnormality detection process will be explained later with reference to FIG. 9.

3.2 First Abnormality Detection Process

Figure 7:
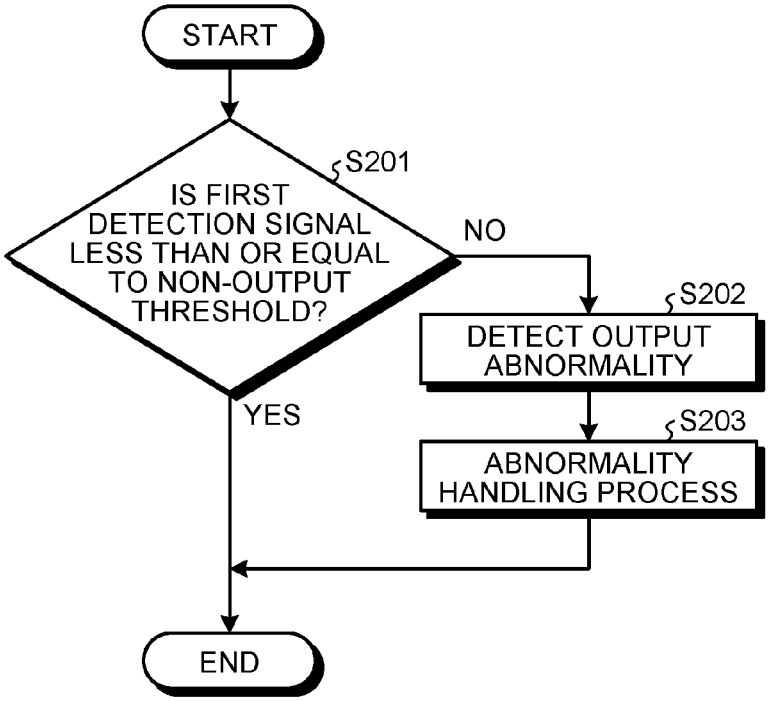
FIG. 7 is a flow chart illustrating a procedure for a first abnormality detection process.

Next, a sequence for the first abnormality detection process performed in the non-output state st1 will be explained with reference to FIG. 7. FIG. 7 is a flow chart illustrating the procedure for the first abnormality detection process.

In the non-output state st1, the abnormality detecting unit 10*b* determines whether or not the value of the first detection signal is less than or equal to the non-output threshold H1 (see FIG. 5), (Step S201). In the determination process, when it is determined that the value of the first detection signal is less than or equal to the non-output threshold H1 (Step S201; Yes), the abnormality detecting unit 10*b* determines that the output abnormality of the high frequency does not exists, and terminates the sequence.

Otherwise, in Step S201, when the value of the first detection signal exceeds the non-output threshold H1 (Step S201; No), the abnormality detecting unit 10*b* detects the output abnormality of the high frequency (Step S202), performs the abnormality handling process (Step S203), and terminates the sequence.

3.3 Second Abnormality Detection Process

Figure 8:
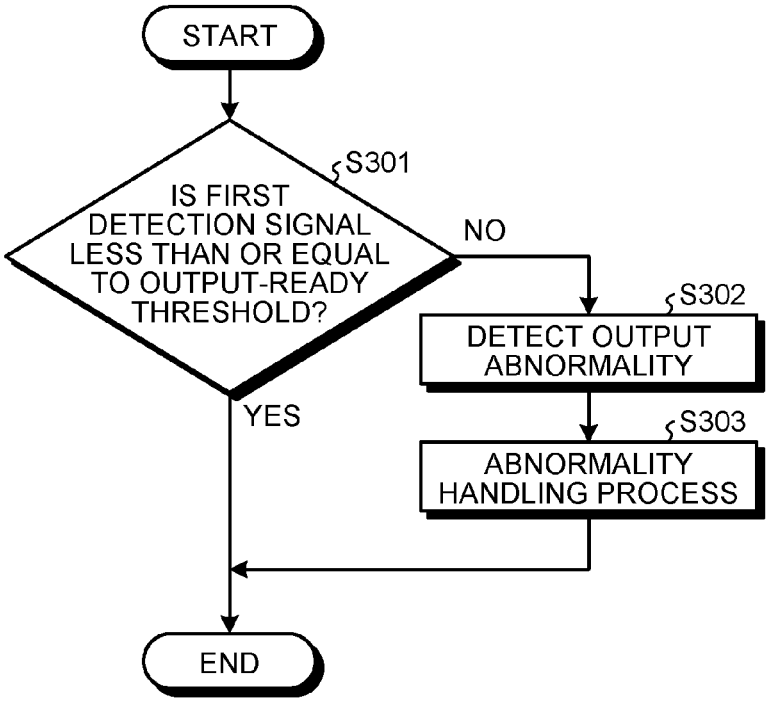
FIG. 8 is a flow chart illustrating a procedure for a second abnormality detection process.

Next, the sequence for the second abnormality detection process performed in the output-ready state st2 will be explained with reference to FIG. 8. FIG. 8 is a flow chart illustrating the procedure for the second abnormality detection process.

In the output-ready state st2, the abnormality detecting unit 10*b* determines whether or not the value of the first detection signal is less than or equal to the output-ready threshold H2 (see FIG. 5), (Step S301). In the determination process, when it is determined that the value of the first detection signal is less than or equal to the output-ready threshold H2 (Step S301; Yes), the abnormality detecting unit 10*b* determines that the output abnormality of the high frequency does not exists, and terminates the sequence.

Otherwise, in Step S301, when the value of the first detection signal exceeds the output-ready threshold H2 (Step S301; No), the abnormality detecting unit 10*b* detects the output abnormality of the high frequency (Step S302), performs the abnormality handling process (Step S303), and terminates the sequence.

3.4 Third Abnormality Detection Process

Figure 9:
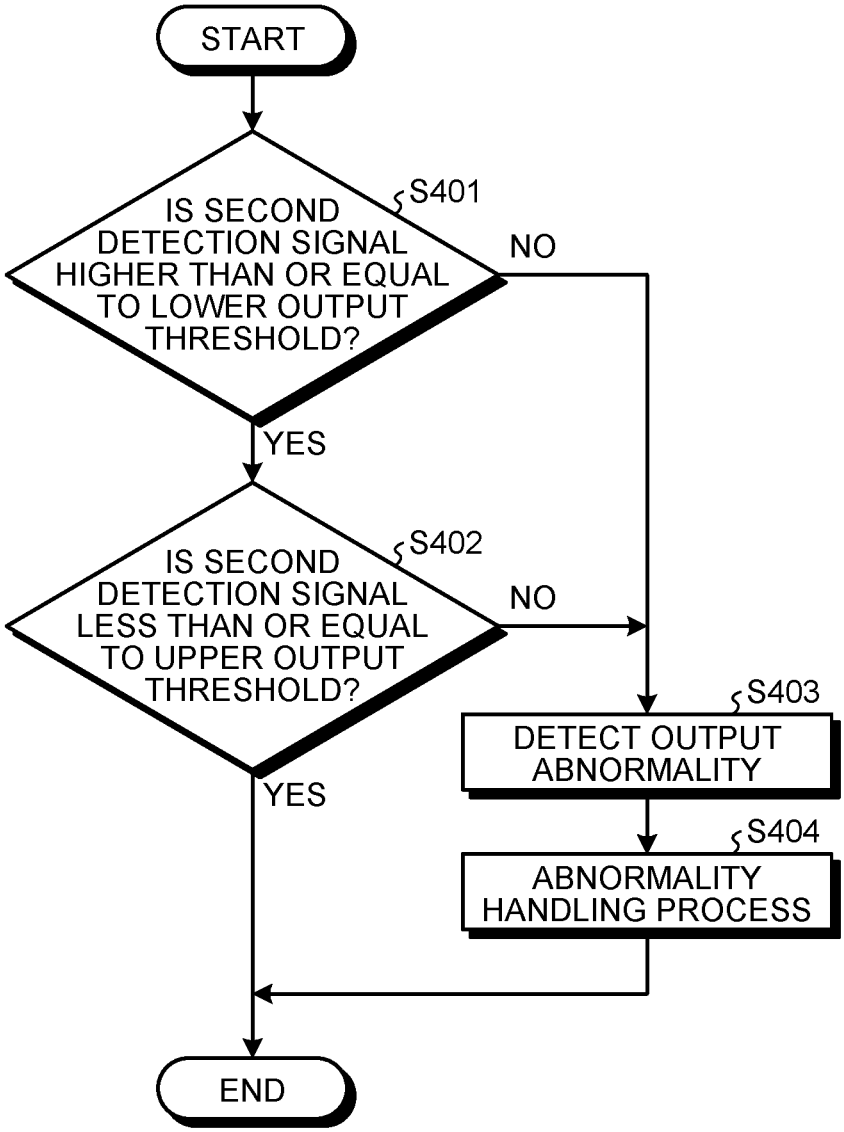
FIG. 9 is a flow chart illustrating a procedure for a third abnormality detection process.

Next, a sequence for the third abnormality detection process performed in the output state st3 will be explained with reference to FIG. 9. FIG. 9 is a flow chart illustrating the procedure for the third abnormality detection process.

In the output state st3, the abnormality detecting unit 10*b* determines whether or not the value of the second detection signal is higher than or equal to the lower output threshold H3 (Step S401). In the determination process, when it is determined that the value of the second detection signal is higher than or equal to the lower output threshold H3 (see FIG. 5), (Step S401: Yes), the abnormality detecting unit 10*b* determines whether or not the value of the second detection signal is less than or equal to the upper output threshold H4 (see FIG. 5), (Step S402).

In the determination process of Step S402, when it is determined that the value of the second detection signal is less than or equal to the upper output threshold H4 (Step S402: Yes), the abnormality detecting unit 10*b* terminates the abnormality detection process.

Otherwise, when the value of the second detection signal is less than the lower output threshold H3 in Step S401 (Step S401: No), or the value of the second detection signal is higher than the upper output threshold H4 in Step S402 (Step S402: No), the abnormality detecting unit 10*b* detects the output abnormality of the high frequency (Step S403), performs the abnormality handling process (Step S404), and terminates the sequence. Not limited to the aforementioned order, the abnormality detecting unit 10*b* may perform the process of Step S402 prior to the process of Step S401.

As described above, the high frequency generating device 1 according to the present embodiment includes the high frequency output unit 11, the output control unit 10*a*, the current detecting unit 13, and the abnormality detecting unit 10*b*. The high frequency output unit 11 includes the oscillation unit 11*a* that oscillates the high frequency and the amplification unit 11*b* that amplifies the high frequency oscillated by the oscillation unit 11*a*. The output control unit 10*a* shifts a state of the oscillation unit 11*a* from the oscillation disabled state to the oscillation enabled state of the high frequency to shift a state of the high frequency output unit 11 from the non-output state to the output-ready state of the high frequency in accordance with timing at which an ignition signal that controls a spark discharge of the ignition plug 4 is output. The current detecting unit 13 is provided on the power-supply path L to the high frequency output unit 11 and detects the current that flows through the power-supply path L. The abnormality detecting unit 10*b* detects output abnormality of the high frequency based on the detection result of the current detecting unit 13 and further detects the output abnormality of the high frequency in the non-output state when the value of the current detected by the current detecting unit 13 in the non-output state exceeds the non-output threshold that is less than or equal to the value of the current that flows through the power-supply path L when the state of the oscillation unit 11*a* becomes the oscillation enabled state. As described above, according to an aspect of the embodiment, the output abnormality of the high frequency can be detected.

In the aforementioned embodiments, the output control unit 10*a* determines the output-ready state st2 and the output state st3 according to the state of the ignition signal input directly to switch control, however, it may be possible to shift the state on the basis of the instruction from the engine control unit 2 instead of inputting the ignition signal.

Specifically, the engine control unit 2 may instruct the output control unit 10*a* to shift from the non-output state st1 to the output-ready state st2 upon outputting an ignition signal, and instruct the output control unit 10*a* to shift from the output-ready state st2 to the output state st3 upon stopping the output of the ignition signal.

Also, in the case of the shift from the output state st3 to the non-output state st1, the engine control unit 2 may instruct the output control unit 10*a* to shift from the output state st3 to the non-output state st1 in the same manner as the above, however, it may be also possible that the output control unit 10*a* itself calculates a time from timing at which the shift to the output state is performed, and shifts to the non-output state st1 after a predetermined time has elapsed. In this way, the states may be shifted according to the timing at which the ignition signal that controls the spark discharge of the ignition plug is output or the timing at which the output of the ignition signal is stopped.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A high frequency generating device used in a plasma ignition apparatus, the high frequency generating device comprising:

a high frequency output unit including:

an oscillation unit that oscillates a high frequency; and an amplification unit that amplifies the high frequency oscillated by the oscillation unit;

an output control unit that shifts a state of the oscillation unit from an oscillation disabled state to an oscillation enabled state of the high frequency to shift a state of the high frequency output unit from a non-output state to an output-ready state of the high frequency in accordance with timing at which an ignition signal that controls a spark discharge of an ignition plug is output;

a current detecting unit that is provided on a power-supply path to the high frequency output unit, the current detecting unit detecting a current that flows through the power-supply path; and an abnormality detecting unit that detects output abnormality of the high frequency based on a detection result of the current detecting unit, wherein the abnormality detecting unit detects output abnormality of the high frequency in the non-output state when a value of a current detected by the current detecting unit in the non-output state exceeds a non-output threshold that is less than or equal to a value of a current that flows through the power-supply path when the state of the oscillation unit becomes the oscillation enabled state.

2. The high frequency generating device used in the plasma ignition apparatus according to claim 1, wherein the abnormality detecting unit detects output abnormality of the high frequency in the output-ready state when a value of a current detected by the current detecting unit in the output-ready state exceeds an output-ready threshold that is higher than the value of the current that flows through the power-supply path when the state of the oscillation unit becomes the oscillation enabled state.

3. The high frequency generating device used in the plasma ignition apparatus according to claim 1, wherein the output control unit instructs, after the state of the high frequency output unit is shifted from the non-output state to the output-ready state, the oscillation unit to oscillate the high frequency and the amplification unit to amplify the high frequency to shift the state of the high frequency output unit from the output-ready state to an output state, and the abnormality detecting unit detects output abnormality of the high frequency in the output state when a value of a current detected by the current detecting unit in the output state deviates from a predetermined range.

4. The high frequency generating device used in the plasma ignition apparatus according to claim 3, wherein the abnormality detecting unit determines whether or not the value of the current detected by the current detecting unit deviates from the predetermined range after a predetermined time has elapsed from a time at which the state of the high frequency output unit is shifted from the output-ready state to the output state.

5. The high frequency generating device used in the plasma ignition apparatus according to claim 3, the high frequency generating device further comprising:

first and second input paths through which the detection result of the current detecting unit is input to the abnormality detecting unit; and an amplifier that is provided on the first input path, the amplifier amplifying an output level of the detection result, wherein the abnormality detecting unit detects the output abnormality of the high frequency in the non-output state based on the detection result input through the first input path and the amplifier, and detects the output abnormality of the high frequency in the output state based on the detection result input through the second input path.

6. The high frequency generating device used in the plasma ignition apparatus according to claim 1, wherein the abnormality detecting unit inhibits the state of the oscillation unit from being shifted from the oscillation disabled state to the oscillation enabled state when detecting the output abnormality.

7. The high frequency generating device used in the plasma ignition apparatus according to claim 1, the high frequency generating device further comprising:

a switch provided on the power-supply path, wherein the abnormality detecting unit controls the switch to cut off power supply to the high frequency output unit when detecting the output abnormality.

8. The high frequency generating device used in the plasma ignition apparatus according to claim 1, wherein the output control unit controls the amplification unit in accordance with a setting signal including setting parameters for the high frequency, and controls the amplification unit to amplify the high frequency at an amplification factor that is less than an amplification factor set by the setting signal when the output abnormality is detected by the abnormality detecting unit.

9. A high frequency generating device used in a plasma ignition apparatus, the high frequency generating device comprising:

a high frequency output unit including:

an oscillation unit that oscillates a high frequency; and an amplification unit that amplifies the high frequency oscillated by the oscillation unit;

an output control unit that shifts a state of the oscillation unit from an oscillation disabled state to an oscillation enabled state of the high frequency to shift a state of the high frequency output unit from a non-output state to an output-ready state of the high frequency in accordance with timing at which an ignition signal that controls a spark discharge of an ignition plug is output;

a current detecting unit that is provided on a power-supply path to the high frequency output unit, the current detecting unit detecting a current that flows through the power-supply path; and an abnormality detecting unit that detects output abnormality of the high frequency based on a detection result of the current detecting unit, wherein the abnormality detecting unit detects output abnormality of the high frequency in the output-ready state when a value of a current detected by the current detecting unit in the output-ready state exceeds an output-ready threshold that is higher than a value of a current that flows through the power-supply path when the state of the oscillation unit becomes the oscillation enabled state.

10. A high frequency generating method used in a plasma ignition apparatus, the high frequency generating method comprising:

(a) shifting a state of an oscillation unit from an oscillation disabled state to an oscillation enabled state of a high frequency to shift a state of a high frequency output unit from a non-output state to an output-ready state of the high frequency in accordance with timing at which an ignition signal that controls a spark discharge of an ignition plug is output, the high frequency output unit including the oscillation unit that oscillates the high frequency and an amplification unit that amplifies the high frequency oscillated by the oscillation unit;

(b) detecting a current that flows through a power-supply path to the high frequency output unit; and (c) detecting output abnormality of the high frequency based on a detection result of the (b) detecting, wherein the (c) detecting includes detecting output abnormality of the high frequency in the output-ready state when a value of a current detected in the (b) detecting in the output-ready state exceeds an output-ready threshold that is higher than a value of a current that flows through the power-supply path when the state of the oscillation unit becomes the oscillation enabled state.

* * * * *